US007124078B2

(12) United States Patent
Accardi et al.

(10) Patent No.: US 7,124,078 B2
(45) **Date of Patent: *Oct. 17, 2006**

(54) SYSTEM AND METHOD OF CODING SOUND SIGNALS USING SOUND ENHANCEMENT

(75) Inventors: Anthony J. Accardi, Somerset, NJ (US); Richard Vandervoort Cox, New Providence, NJ (US)

(73) Assignee: AT&T Corp., New York, NY (US)

( * ) Notice: Subject to any disclaimer, the term of this patent is extended or adjusted under 35 U.S.C. 154(b) by 58 days.

This patent is subject to a terminal disclaimer.

(21) Appl. No.: 10/969,115

(22) Filed: Oct. 20, 2004

(65) Prior Publication Data

US 2005/0055219 A1 Mar. 10, 2005

Related U.S. Application Data

(63) Continuation of application No. 09/725,506, filed on Nov. 30, 2000, now Pat. No. 6,832,188, which is a continuation of application No. 09/120,412, filed on Jul. 22, 1998, now Pat. No. 6,182,033.

(60) Provisional application No. 60/071,051, filed on Jan. 9, 1998.

(51) Int. Cl.
*G10L 19/00* (2006.01)
*G10L 19/06* (2006.01)

(52) U.S. Cl. ..... 704/223; 704/219; 704/226

(58) Field of Classification Search ..... None
See application file for complete search history.

(56) References Cited

U.S. PATENT DOCUMENTS 4,472,832 A 9/1984 Atal et al.
4,486,900 A 12/1984 Cox et al.
4,551,580 A 11/1985 Cox et al.
RE32,580 E 1/1988 Atal et al.
4,896,361 A * 1/1990 Gerson ..... 704/222
5,434,920 A 7/1995 Cox et al.
5,495,555 A * 2/1996 Swaminathan ..... 704/207
5,594,798 A 1/1997 Cox et al.
6,073,092 A * 6/2000 Kwon ..... 704/219
6,131,084 A * 10/2000 Hardwick ..... 704/230
6,161,089 A * 12/2000 Hardwick ..... 704/230
6,173,257 B1 * 1/2001 Gao ..... 704/220
6,182,033 B1 * 1/2001 Accardi et al. ..... 704/223
6,260,009 B1 * 7/2001 Dejaco ..... 704/221
6,345,248 B1 * 2/2002 Su et al. ..... 704/223
6,782,359 B1 * 8/2004 Lin et al. ..... 704/219
6,832,188 B1 * 12/2004 Accardi et al. ..... 704/223
6,889,185 B1 * 5/2005 McCree ..... 704/222

FOREIGN PATENT DOCUMENTS

EP 0732687 A2 9/1996
EP 0742548 A2 11/1996

* cited by examiner

*Primary Examiner*—Susan McFadden

(57) ABSTRACT

A speech coder comprises a first speech enhancement module receiving a digitized speech signal and producing a first enhanced speech signal, a second speech enhancement module receiving the digitized speech signal and producing a second enhanced speech signal, an analysis module that receives the second enhanced speech signal and produces an analyzed speech signal, a first weighting filter that receives the second enhanced speech signal and the analyzed speech signal and produces a second weighted enhanced signal, a quantizer module that receives the analyzed speech signal and produces a quantized speech signal, a synthesizer module that receives the quantized speech signal and an error signal to produce a synthesized speech output signal and a second weighting filter that receives the synthesized speech output signal to produce a first weighted enhanced signal. A subtraction module calculates a difference between the first weighted enhanced signal and the second weighted enhanced signal which difference is utilized to calculate the error signal.

26 Claims, 2 Drawing Sheets

SYSTEM AND METHOD OF CODING SOUND SIGNALS USING SOUND ENHANCEMENT

CROSS-REFERENCE TO RELATED APPLICATIONS

The present application claims priority to U.S. patent application Ser. No. 09/725,506 filed on Nov. 30, 2000, now U.S. Pat No. 6,832,188 which claims priority to U.S. patent application Ser. No. 09/120,412, filed on Jul. 22, 1998 (now U.S. Pat. No. 6,182,033), which is a non-provisional application claiming priority to U.S. Provisional Patent Application No. 60/071,051 filed Jan. 9, 1998. Each of these patent applications is incorporated herein by reference.

BACKGROUND OF THE INVENTION

There are many environments where noisy conditions interfere with speech, such as the inside of a car, a street or a busy office. The severity of background noise varies from the gentle hum of a fan inside of computer to a cacophonous babble in a crowded cafe. This background noise not only directly interferes with a listener's ability to understand a speaker's speech, but can cause further unwanted distortions if the speech is encoded or otherwise processed. Speech enhancement is an effort to process the noisy speech for the benefit of the intended listener, be it a human, speech recognition module, or anything else. For a human listener, it is desirable to increase the perceptual quality and intelligibility of the perceived speech, so that the listener understands the communication with minimal effort and fatigue.

It is usually the case that for a given speech enhancement scheme, a tradeoff must be made between the amount of noise removed and the distortion introduced as a side effect. If too much noise is removed, the resulting distortion can result in listeners preferring the original noise scenario to the enhanced speech. Preferences are based on more than just the energy of the noise and distortion: unnatural sounding distortions become annoying to humans when just audible, while a certain elevated level of "natural sounding" background noise is well tolerated. Residual background noise also serves to perceptually mask slight distortions, making its removal even more troublesome.

Speech enhancement can be broadly defined as the removal of additive noise from a corrupted speech signal in an attempt to increase the intelligibility or quality of speech. In most speech enhancement techniques, the noise and speech are generally assumed to be uncorrelated. Single channel speech enhancement is the simplest scenario, where only one version of the noisy speech is available, which is typically the result of recording someone speaking in a noisy environment with a single microphone.

FIG. 1 illustrates a speech enhancement setup for N noise sources for a single-channel system. For the single channel case illustrated in FIG. 1, exact reconstruction of the clean speech signal is usually impossible in practice. So speech enhancement algorithms must strike a balance between the amount of noise they attempt to remove and the degree of distortion that is introduced as a side effect. Since any noise component at the microphone cannot in general be distinguished as coming from a specific noise source, the sum of the responses at the microphone from each noise source is denoted as a single additive noise term.

Speech enhancement has a number of potential applications. In some cases, a human listener observes the output of the speech enhancement directly, while in others speech enhancement is merely the first stage in an communications channel and might be used as a preprocessor for a speech coder or speech recognition module. Such a variety of different application scenarios places very different demands on the performance of the speech enhancement module, so any speech enhancement scheme ought to be developed with the intended application in mind. Additionally, many well-known speech enhancement processes perform very differently with different speakers and noise conditions, making robustness in design a primary concern. Implementation issues such as delay and computational complexity are also considered.

Speech can be modeled as the output of an acoustic filter (i.e., the vocal tract) where the frequency response of the filter carries the message. Humans constantly change properties of the vocal tract to convey messages by changing the frequency response of the vocal tract.

The input signal to the vocal tract is a mixture of harmonically related sinusoids and noise. "Pitch" is the fundamental frequency of the sinusoids. "Formants" correspond to the resonant frequency(ies) of the vocal tract.

A speech coder works in the digital domain, typically deployed after an analog-to-digital (A/D) converter, to process a digitized speech input to the speech coder. The speech coder breaks the speech into constituent parts on an interval-by-interval basis. Intervals are chosen based on the amount of compression or complexity of the digitized speech. The intervals are commonly referred to as frames or sub-frames. The constituent parts include (a) gain components to indicate the loudness of the speech; (b) spectrum components to indicate the frequency response of the vocal tract, where the spectrum components are typically represented by linear prediction coefficients ("LPCs") and/or cepstral coefficients; and (c) excitation signal components, which include a sinusoidal or periodic part, from which pitch is captured, and a noise-like part.

To make the gain components, gain is measured for an internal to normalize speech into a typical range. This is important to be able to run a fixed point processor on the speech.

In the time domain, linear prediction coefficients (LPCs) area weighted linear sum of previous data used to predict the next datum. Cepstral coefficients can be determined from the LPCs, and vice versa. Cepstral coefficients can also be determined using a fast Fourier transform (FFT).

The bandwidth of a telephone channel is limited to 3.5 kHz. Upper (higher-frequency) formants can be lost in coding.

Noise affects speech coding, and the spectrum analysis can be adversely affected. The speech spectrum is flattened out by noise, and formants can be lost in coding. Calculation of the LPC and the cepstral coefficients can be affected.

The excitation signal (or "residual signal") components are determined after or separate from the gain components and the spectrum components by breaking the speech into a periodic part (the fundamental frequency) and a noise part. The processor looks back one (pitch) period (1/F) of the fundamental frequency (F) of the vocal tract to take the pitch, and makes the noise part from white noise. A sinusoidal or periodic part and a noise-like part are thus obtained.

Speech enhancement is needed because the more the speech coder is based on a speech production model, the less able, it is to render faithful reproductions of non-speech sounds that are passed through the speech coder. Noise does not fit traditional speech production models. Non-speech sounds sound peculiar and annoying. The noise itself may be considered annoying by many people. Speech enhancement has never been shown to improve intelligibility but has often been shown to improve the quality of uncoded speech.

According to previous practice, speech enhancement was performed prior to speech coding, in a speech enhancement system separated from a speech coder/decoder, as shown in FIG. 2. With reference to FIG. 2, the speech enhancement module 6 is separated from the speech coder/decoder 8. The speech enhancement module 6 receives input speech. The speech enhancement module 6 enhances (e.g., removes noise from) the input speech and produces enhanced speech.

The speech coder/decoder 8 receives the already enhanced speech from the speech enhancement module 6. The speech coder/decoder 8 generates output speech based on the already-enhanced speech. The speech enhancement module 6 is not integral with the speech coder/decoder 8.

Previous attempts at speech enhancement and coding first cleaned up the speech as a whole, and then coded it, setting the amount of enhancement via "tuning".

SUMMARY OF THE INVENTION

According to an exemplary embodiment of the invention, a system for enhancing and coding speech performs the steps of receiving digitized speech and enhancing the digitized speech to extract component parts of the digitized speech. The digitized speech is enhanced differently for each of the component parts extracted.

According to an aspect of the invention, an apparatus for enhancing and coding speech includes a speech coder that receives digitized speech. A spectrum signal processor within the speech coder determines spectrum components of the digitized speech. An excitation signal processor within the speech coder determines excitation signal components of the digitized speech. A first speech enhancement system within the speech coder processes the spectrum components. A second speech enhancement system within the speech coder processes the excitation signal components.

Other features and advantage of the invention will become apparent from the following detailed description, taken in conjunction with the accompanying drawings, which illustrate, by way of example, the features of the invention.

DETAILED DESCRIPTION

Previous speech enhancement techniques were separated from, and removed noise prior to, speech coding. According to the principles of the invention a speech enhancement system is integral with a speech coder such that differing speech enhancement processes are used for particular (e.g., gain, spectrum and excitation) components of the digitized speech while the speech is being coded.

Speech enhancement is performed within the speech coder using one speech enhancement system as a preprocessor for the LPC filter computer and a different speech enhancement system as a preprocessor for the speech signal from which the residual signal is computed. The two speech enhancement processes are both within the speech coder. The combined speech enhancement and speech coding method is applicable to both time-domain coders and frequency-domain coders.

Figure 1:
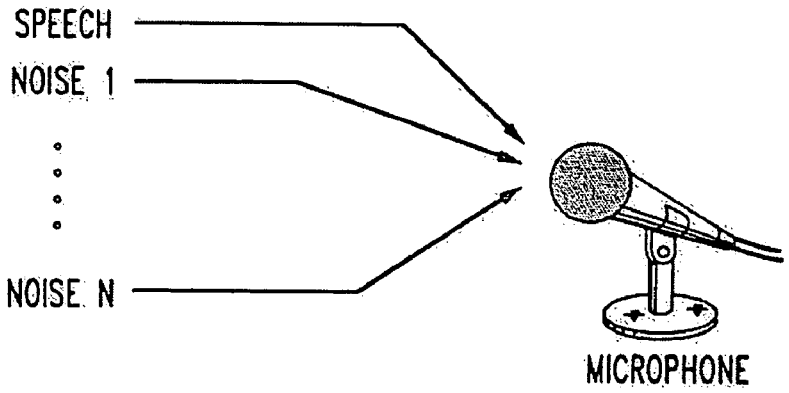
FIG. 1 PRIOR ART
FIG. 1 illustrate a speech enhancement setup for N noise sources for a single-channel system.
Figure 2:
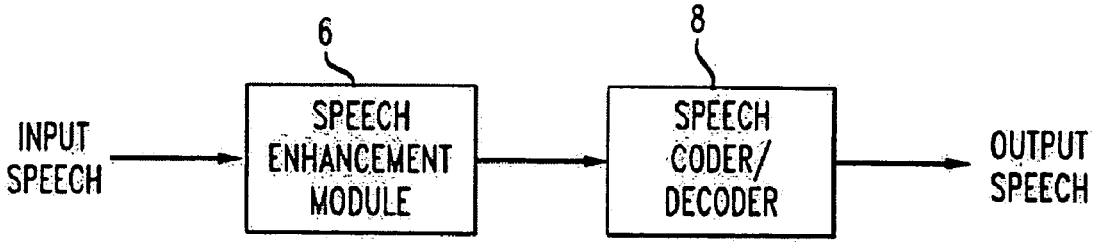
FIG. 2 PRIOR ART
FIG. 2 illustrates a conventional speech enhancement and coding system.
Figure 3:
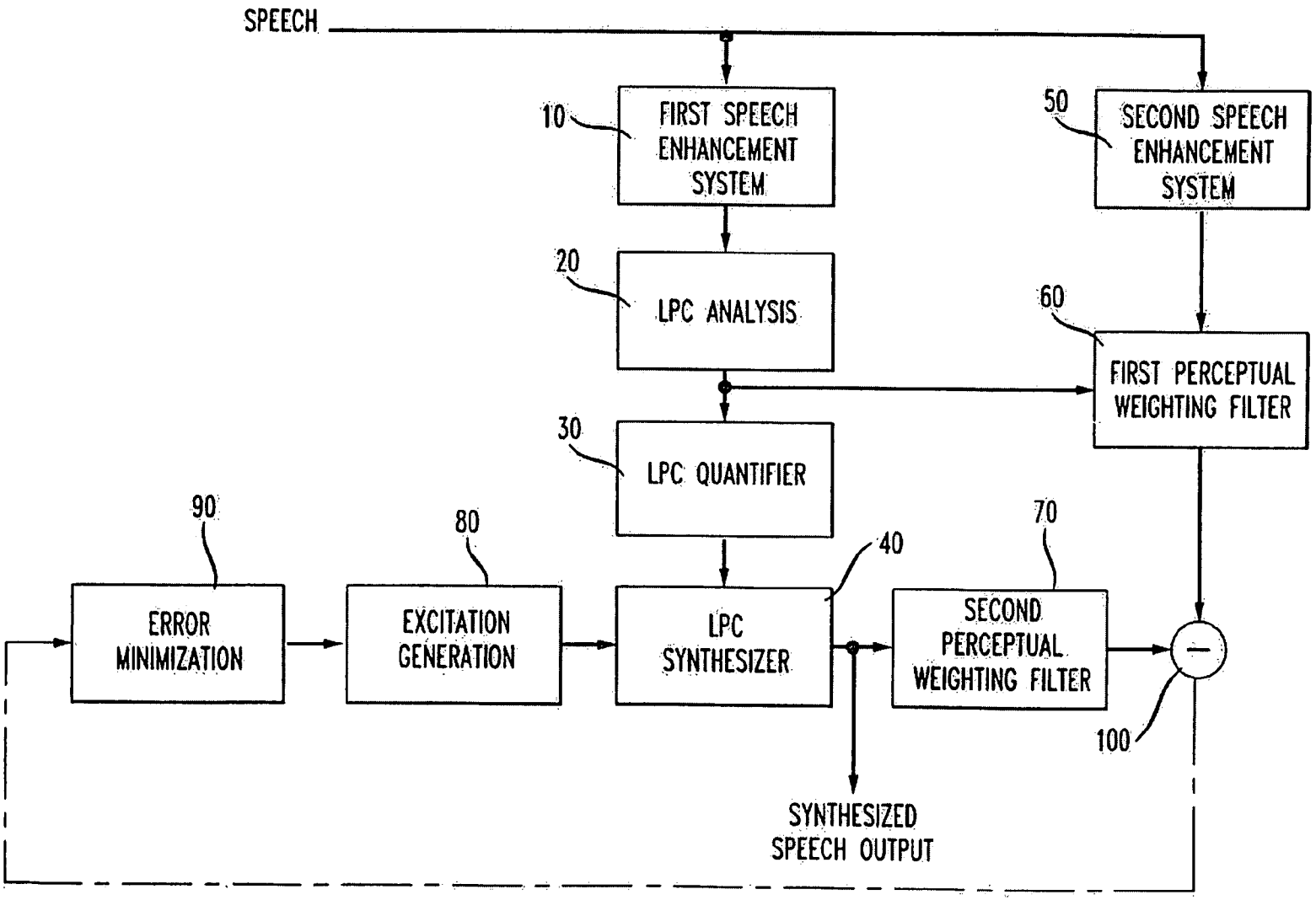
FIG. 3 illustrates a speech enhancement and coding system in accordance with the principles of the invention.

FIG. 3 is a schematic view of an apparatus which integrates speech enhancement into a speech coder in accordance with the principles of the invention. The apparatus illustrated in FIG. 3 includes a first speech enhancement system 10. The first speech enhancement system 10 receives an input speech signal, which has been digitized. An LPC analysis computer (LPC analyzer) 20 is coupled to the first speech enhancement system 10. An LPC quantizer 30 is coupled to the LPC analysis computer 20. An LPC synthesis filter (LPC synthesizer) 40 is coupled to the LPC quantizer 30.

A second speech enhancement system 50 receives the digitized input speech signal. A first perceptual weighting filter 60 is coupled to the second speech enhancement system 50 and to the LPC analyzer 20. A second perceptual weighting filter 70 is coupled to the LPC analyzer 20 and to the LPC synthesizer 40.

A subtractor 100 is coupled to the first perceptual weighting filter 60 and the second perceptual weighting filter 70. The subtractor 100 produces an error signal based on the difference of two inputs. An error minimization processor 90 is coupled to the subtractor 100. An excitation, generation processor 80 is coupled to the error minimization processor 90. The LPC synthesis filter 40 is coupled to the excitation generation processor 80.

The first speech enhancement system 10 and the second speech enhancement system 50 are integral with the rest of the apparatus illustrated in FIG. 3. The first speech enhancement system 10 and the second speech enhancement system 50 can be entirely different or can represent different "tunings" that give different amounts of enhancement using the same basic system.

The first speech enhancement system 10 enhances speech prior to computation of spectral parameters, which in this example is an LPC analysis. The LPC analysis system 20 carries out the LPC spectral analysis. The LPC analysis system 20 determines the best acoustic filter, which is represented as a sequence of LPC parameters. The output LPC parameters of the LPC spectral analysis are used for two different purposes in this example.

The unquantized LPC parameters are used to compute coefficient values in the first perceptual weighting filter 60 and the second perceptual weighting filter 70.

The unquantized LPC values are also quantized in the LPC quantizer 30. The LPC quantizer 30 produces the best estimate of the spectral information as a series of bits. The quantized values produced by the LPC quantizer 30 are used as the filter coefficients in the LPC synthesis filter (LPC synthesizer) 40. The LPC synthesizer 40 combines the excitation signal indicating pulse amplitudes and locations, produced by the excitation generation processor 80 with the quantized values representing the best estimate of the spectral information that are output from the LPC quantizer 30.

The second speech enhancement system 50 is used in determining the excitation signal produced by the excitation generation processor 80. The digitized speech signal is input to the second speech enhancement system 50. The enhanced speech signal output from the second speech enhancement system 50 is perceptually weighted in the first perceptual weighting filter 60. The first perceptual weighting filter 60 weights the speech with respect to perceptual quality to a listener. The perceptual quality continually changes based on the acoustic filter (i.e., based on the frequency response of the vocal tract) represented by the output of the LPC analyzer 20. The first perceptual weighing filter 60 thus operates in the psychophysical domain, in a "perceptual space" where mean square error differences are relevant to the coding distortion that a listener hears.

According to the exemplary embodiment of the invention illustrated in FIG. 3, all possible excitation sequences are generated in the excitation generation processor 80. The possible excitation sequences generated by excitation generator 80 are input to the LPC synthesizer 40. The LPC synthesizer 40 generates possible coded output signals based on the quantized values representing the best estimate of the spectral information generated by LPC quantizer 30 and the possible excitation sequences generated by excitation generation processor 80. The possible coded output signals from the LPC synthesizer 40 can be sent to a digital to analog (A/D) converter for further processing.

The possible coded output signals from the LPC synthesizer 40 are passed through the second perceptual weighting filter 70. The second perceptual weighting filter 70 has the same coefficients as the first perceptual weighting filter 60. The first perceptual weighting filter 60 filters the enhanced speech signal whereas the second perceptual weighting filter 70 filters possible speech output signals. The second perceptual weighing filter 70 tries all of the different possible excitation signals to get the best decoded speech.

The perceptually weighted possible output speech signals from the second perceptual weighting filter 70 and the perceptually weighted enhanced input speech signal from the first perceptual weighting filter 60 are input to the subtractor 100. The subtractor 100 determines a signal representing a difference between perceptually weighted possible output speech signals from the second perceptual weighting filter 70 and the perceptually weighted enhanced input speech signal from the first perceptual weighting filter 60. The subtractor 100 produces an error signal based on the signal representing such difference.

The output of the subtractor 100 is coupled to the error minimization processor 90. The error minimization processor 90 selects the excitation signal that minimizes the error signal output from the subtractor 100 as the optimal excitation signal. The quantized LPC values from LPC quantizer 30 and the optimal excitation signal from the error minimization on processor 90 are the values that are transmitted to the speech decoder and can be used to re-synthesize the output speech signal.

The first speech enhancement system 10 and the second speech enhancement system 50 within the apparatus illustrated in FIG. 3 can (i) apply differing amounts of the same speech enhancement process, or (ii) apply different speech enhancement processes.

The principles of the invention can be applied to frequency-domain coders as well as timed-domain coders, and are particularly useful in a cellular telephone environment where bandwidth is limited. Because the bandwidth is limited, transmissions of cellular telephone calls use compression and often require speech enhancement. The noisy acoustic environment of a cellular telephone favors the use of a speech enhancement process. Generally, speech coders that use a great deal of compression need a lot of speech enhancement, while those using less compression need less speech enhancement.

Examples of recent speech enhancement schemes which can be used as the first and second speech enhancement systems 10, 50 are described in the article by E. J. Diethorn, "A Low-Complexity, Background-Noise Reduction Preprocessor for Speech Encoders," presented at IEEE Workshop on Speech Coding for Telecommunications, Pocono Manor Inn, Pocono Manor, Pa., 1997; and in the article by T. V. Ramabadran, J. P. Ashley, and M. J. McLaughlin, "Background Noise Suppression for Speech Enhancement and Coding," presented at IEEE Workshop on Speech Coding for Telecommunications, Pocono Manor Inn, Pocono Manor, Pa., 1997. The latter article describes the enhancement system prescribed for use in the Interim Standard 127 (IS-127) promulgated by the Telecommunications Industry Association (TIA).

The invention combines the strengths of multiple speech enhancement systems in order to generate a robust and flexible speech enhancement and coding process that exhibits better performance. Experimental data indicate that a combination enhancement approach leads to a more robust and flexible system that shares the benefits of each constituent speech enhancement process.

While several particular forms of the invention have been illustrated and described, it will also be apparent that various modifications can be made without departing from the spirit and scope of the invention.

We claim:

1. A method for processing a digitized sound signal divided into parts, the method comprising, within a coder:

applying at least two sound signal enhancement processes to the digitized sound signal to produce at least two enhanced digitized sound signals; and coding a sound signal utilizing the at least two enhanced digitized sound signals.

2. The method of claim 1, wherein the sound is speech.

3. The method of claim 1, wherein the step of applying at least two signal enhancement processes further comprises:

applying a first portion of a sound enhancement process to produce a first enhanced digitized sound signal; and applying a second portion of the sound enhancement process to produce a second enhanced digitized sound signal.

4. The method of claim 3, wherein the coding step further comprises:

processing the first enhanced digitized sound signal using a spectrum signal processor to compute spectral parameters; and processing the second enhanced digitized sound signal using an excitation generation processor to determine an excitation signal.

5. The method of claim 4, wherein the spectrum signal processor includes a quantizer.

6. The method of claim 5, wherein the spectral parameters are represented by linear prediction coefficients.

7. The method of claim 4, wherein the spectral parameters are represented by cepstral coefficients.

8. The method of claim 4, wherein the excitation signal includes a periodic part, from which pitch is captured, and a noise-like part.

9. A method for enhancing a digitized audio signal, the method comprising, in a speech coder:

applying a first sound enhancement process associated with speech within the digitized audio signal to produce a first enhanced digitized signal;

applying a second sound enhancement process associated with background noise within the digitized audio signal to produce a second enhanced digitized signal; and computing a coded sound signal by processing the first enhanced digitized signal and the second enhanced digitized signal, wherein the coded sound signal has reduced background noise.

10. The method of claim 9, wherein the first sound enhancement process processes spectrum components within the digitized audio signal.

11. The method of claim 10, wherein the second sound enhancement process processes excitation signal components within the digitized audio signal.

12. The method of claim 11, wherein the excitation signal components include a periodic part, from which pitch is captured, and a noise-like part.

13. The method of claim 9, wherein after applying the first sound enhancement process, the method comprises:

computing spectral parameters on the first enhanced digitized signal.

14. A speech coder that processes a digitized sound signal divided into parts, the speech coder comprising:

means for applying at least two sound signal enhancement processes to produce at least two enhanced digitized sound signals; and means for computing a coded sound signal utilizing the at least two enhanced digitized sound signals.

15. The speech coder of claim 14, wherein the means for applying at least two signal enhancement processes further comprises:

means for applying a first portion of a sound enhancement process to produce a first enhanced digitized sound signal; and means for applying a second portion of the sound enhancement process to produce a second enhanced digitized sound signal.

16. The speech coder of claim 15, wherein the means for computing further comprises:

means for processing the first enhanced digitized sound signal using a spectrum signal processor to compute spectral parameters; and means for processing the second enhanced digitized sound signal using an excitation generation processor to determine an excitation signal.

17. The speech coder of claim 16, wherein the spectrum signal processor includes a quantizer.

18. The speech coder of claim 16, wherein the spectral parameters are represented by linear prediction coefficients.

19. The speech coder of claim 16, wherein the spectral parameters are represented by cepstral coefficients.

20. The speech coder of claim 16, wherein the excitation signal includes a periodic part, from which pitch is captured, and a noise-like part.

21. A speech coder comprising:

a first speech enhancement module receiving a digitized speech signal and producing a first enhanced speech signal;

a second speech enhancement module receiving the digitized speech signal and producing a second enhanced speech signal;

an analysis module that receives the second enhanced speech signal and produces an analyzed speech signal;

a first weighting filter that receives the second enhanced speech signal and the analyzed speech signal and produces a second weighted enhanced signal;

a quantizer module that receives the analyzed speech signal and produces a quantized speech signal;

a synthesizer module that receives the quantized speech signal and an error signal to produce a synthesized speech output signal; and a second weighting filter that receives the synthesized speech output signal to produce a first weighted enhanced signal, wherein a subtraction module calculates a difference between the first weighted enhanced signal and the second weighted enhanced signal which difference is utilized to calculate the error signal.

22. The speech coder of claim 21, wherein background noise is minimized within the synthesized speech output signal.

23. The speech coder of claim 21, wherein the analyzer module is an LPC analyzer module and the quantifier module is an LPC quantifier.

24. The speech coder of claim 23, wherein the synthesizer module is an LPC synthesizer.

25. The speech coder of claim 21, wherein the first speech enhancement module is a spectrum signal processor that determines spectrum components within the digitized speech.

26. The speech coder of claim 25, wherein the second speech enhancement module is an excitation signal processor that determines excitation signal components of the digitized speech.

* * * * *